US005330135A

United States Patent [19]

Roberts

[11] Patent Number: 5,330,135

[45] Date of Patent: Jul. 19, 1994

[54] RAILWAY TRACK CIRCUITS

[75] Inventor: Richard J. Roberts, Melksham, United Kingdom

[73] Assignee: Westinghouse Brake and Signal Holdings Ltd., Chippenham

[21] Appl. No.: 962,454

[22] Filed: Oct. 16, 1992

[30] Foreign Application Priority Data

Oct. 23, 1991 [GB] United Kingdom ..... 9122438

[51] Int. Cl.[5] ..... B61L 25/00

[52] U.S. Cl. ..... 246/34 R; 246/34 B; 246/122 R

[58] Field of Search ..... 246/28 F, 34 R, 34 A, 246/34 B, 34 CT, 40, 121, 122 R

[56] References Cited

U.S. PATENT DOCUMENTS

| | | | |
|---|---|---|---|
| 3,575,595 | 4/1971 | Pace | 246/34 CT |
| 3,666,217 | 5/1972 | Sibley | 246/34 CT |
| 3,821,544 | 6/1974 | Matty | 246/122 R X |
| 3,829,682 | 8/1974 | Geiger | 246/125 |
| 3,868,075 | 2/1975 | Blazek et al. | 246/34 CT |
| 4,074,879 | 2/1978 | Clark et al. | 246/34 CT X |
| 4,369,942 | 1/1983 | Wilson | 246/34 CT |
| 4,415,134 | 11/1983 | Wilson | 246/34 B X |
| 4,498,650 | 2/1985 | Smith et al. | 246/34 A X |
| 4,619,425 | 10/1986 | Nagel | 246/34 R |
| 5,145,131 | 9/1992 | Franke | 246/122 R |

FOREIGN PATENT DOCUMENTS 2073928 10/1981 United Kingdom .

*Primary Examiner*—David A. Bucci
*Assistant Examiner*—Scott L. Lowe
*Attorney, Agent, or Firm*—Welsh & Katz, Ltd.

[57] ABSTRACT

A railway track circuit system is described, in which there is a transmitter 15,16 and receiver 19,20 at each end of a track circuit section 4. Each receiver receives signals from the transmitter at the opposite end of the section and the received signals are analyzed to determine whether a vehicle is present in the track circuit section. Where adjacent track circuit sections are also provided with a transmitter and a receiver at each of their ends, the transmitters 14,17 and receivers 18,21 at adjacent ends of adjacent track sections 3,5 can be connected to a track circuit unit 8,9 to allow that unit to check, when a vehicle appears to have left one track circuit section, that it has entered an adjacent section.

5 Claims, 3 Drawing Sheets

RAILWAY TRACK CIRCUITS

BACKGROUND OF THE INVENTION

This invention relates to railway track circuits.

Railway track circuits are used to detect the presence or position of railway vehicles in a length of railway track. A track circuit system typically comprises two rails of the railway track, side-by-side, each coupled near one end of a section of the track with a transmitter of electrical signals and near the other end with a receiver. When a vehicle is on the rails of the track circuit section of track its axles electrically connect the rails to each other and this is detected by the receiver as a change in the signal received from the transmitter. In a length of track there may be several such track circuit sections separated by, for example, insulative breaks in the rails, fixed connections between the rails ("shorting straps"), or electric filters having an inductance and/or capacitance which prevent the propagation of track circuit signals past the filter from one section of the track to another.

In such a system, if a break occurs in a rail then the transmitted electrical signals may leak through earth to the receiver, bypassing the track circuit and preventing a vehicle in the track section from being detected. If, because no vehicle is detected, it is assumed that there is no vehicle in the section and the section is therefore assumed to be safe for a second vehicle to enter then an accident could result. This is a problem with conventional track circuit systems.

To overcome this problem it is known for the receiver units of a track circuit to transmit data to an overall control system which can compare data from adjacent track circuit sections to ensure that a vehicle has entered one section of track when it is assumed to have left another section. However, this is inconvenient because it requires the control system to perform a function additional to its control function. It is preferable to have all vehicle detection functions performed outside the overall control system.

Also, in a conventional track circuit system the signal transmitted at one end of a track circuit section is attenuated as it passes through the rails to the receiver at the other end of that section (as illustrated in FIG. 1). Therefore, the voltage of the signal in the region of track near the receiver is relatively low. This causes problems because, unless the receiver is extremely sensitive, the change in the level of the received signal when a train connects together the rails in that region is particularly low and is not easily detected—especially if there is, for example, oil lying on the track which disrupts the connection between the rails made by the train. British Patent Specification No. 2 073 928 describes a track circuit system in which a receiver and a transmitter are provided at each end of a track circuit section, each receiver being capable of receiving signals from the transmitter at the opposite end of the track section to it. In determining the presence and/or position of any train in one track circuit section the system makes no use of the results of signalling in other track sections. Therefore, any determination of whether a train has moved from one track section to another must be performed by the system's overall control system.

Other examples of track circuit systems are described in U.S. Pat. Nos. 3 575 595, 3 829 682 and 4 498 650.

SUMMARY OF THE INVENTION

According to one aspect of the present invention there is provided a railway track circuit system for detecting the presence and/or position of a vehicle on a railway track, the track having electrically conductive rails including first and second track circuit sections adjacent one another, the system comprising a first transmitter of signals, a second transmitter of signals, a first receiver, for receiving signals from the second transmitter, and a second receiver, for receiving signals from the first transmitter, the first transmitter and the first receiver being coupled with the rails in the first track circuit section near a first end of that section and the second transmitter and the second receiver being coupled with the rails in the first track section near a second end of that section, and a third transmitter of signals coupled with the rails in the second track circuit section near a first end of that section and a third receiver, for receiving signals from the third transmitter, coupled with the rails in the second track circuit section near-a second end of that section, the first transmitter and the third receiver being connected to a single discrete track circuit unit for estimating the impedance of the first track section and for determining whether a signal from the third transmitter is received by the third receiver at a strength greater than a predetermined strength.

Each track circuit section may suitably have respective first and second transmitters and receivers.

At least one of the transmitters may be capable of transmitting signals intermittently in a predetermined pattern which identifies that transmitter or the track circuit section in which it is connected.

The rails could be divided into track circuit sections by, for example, shorting straps, electric filters or by insulative breaks on the rails. Each transmitter or receiver could be coupled to the rails either by direct connections or by an inductive coupling.

According to a second aspect of the invention, there is provided a railway track circuit system for detecting the presence and/or position of a vehicle on a railway track, the track having electrically conductive rails including a track circuit section, and the system including a transmitter of signals coupled with the rails, wherein the transmitter is capable of transmitting signals intermittently in a predetermined pattern.

According to a third aspect of the present invention there is provided a method for detecting the presence and/or position of a vehicle on a railway track, the track having electrically conductive rails including first and second track circuit sections adjacent one another, the method comprising measuring the impedance of the first track circuit section to find the presence or position of a vehicle-in that section and testing for the presence of a vehicle in the second track circuit section if the measurement of the impedance of the first track circuit section suggests that a vehicle has passed from the first track circuit section to the second track circuit section, and wherein the measurement of the impedance of the first track circuit section and the testing for the presence of a vehicle in the second track circuit section are performed by a single discrete unit.

According to a fourth aspect of the invention there is provided a method for detecting the presence and/or position of a vehicle on a railway track, the track having electrically conductive rails including a track circuit section and there being a transmitter of signals and a receiver for receiving signals from the transmitter, each being coupled to the rails, the method comprising causing the transmitter to transmit signals intermittently in a predetermined pattern.

The present invention will now be described by way of example with reference to FIGS. 2 to 5 of the accompanying drawings in which:

FIG. 1 is a schematic diagram showing signal strength as a function of track position;

FIG. 2*a* and 2*b* are a schematic diagram of a track circuit system;

DETAILED DESCRIPTION OF THE DRAWINGS

Figure 2A:
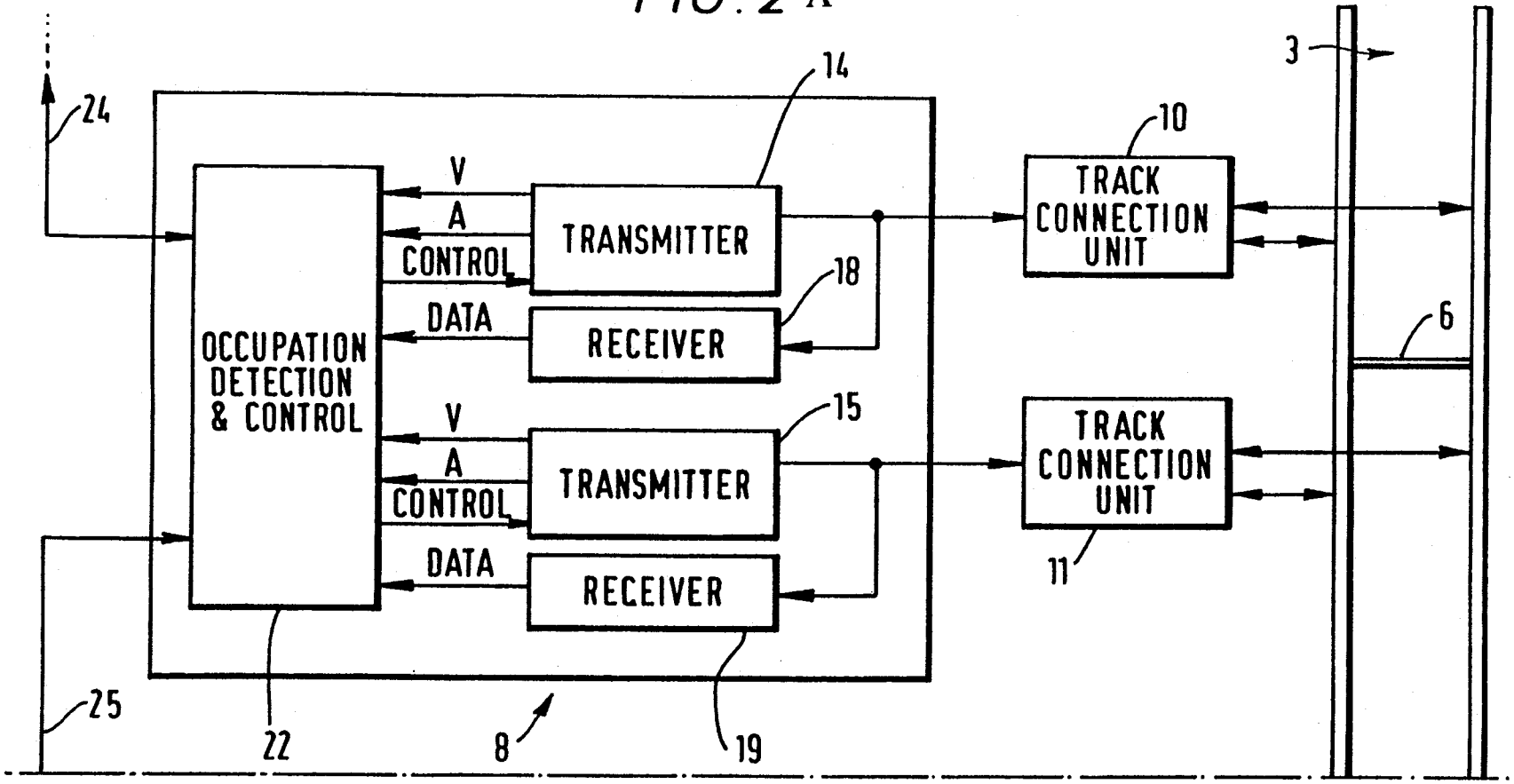
Figure 2B:
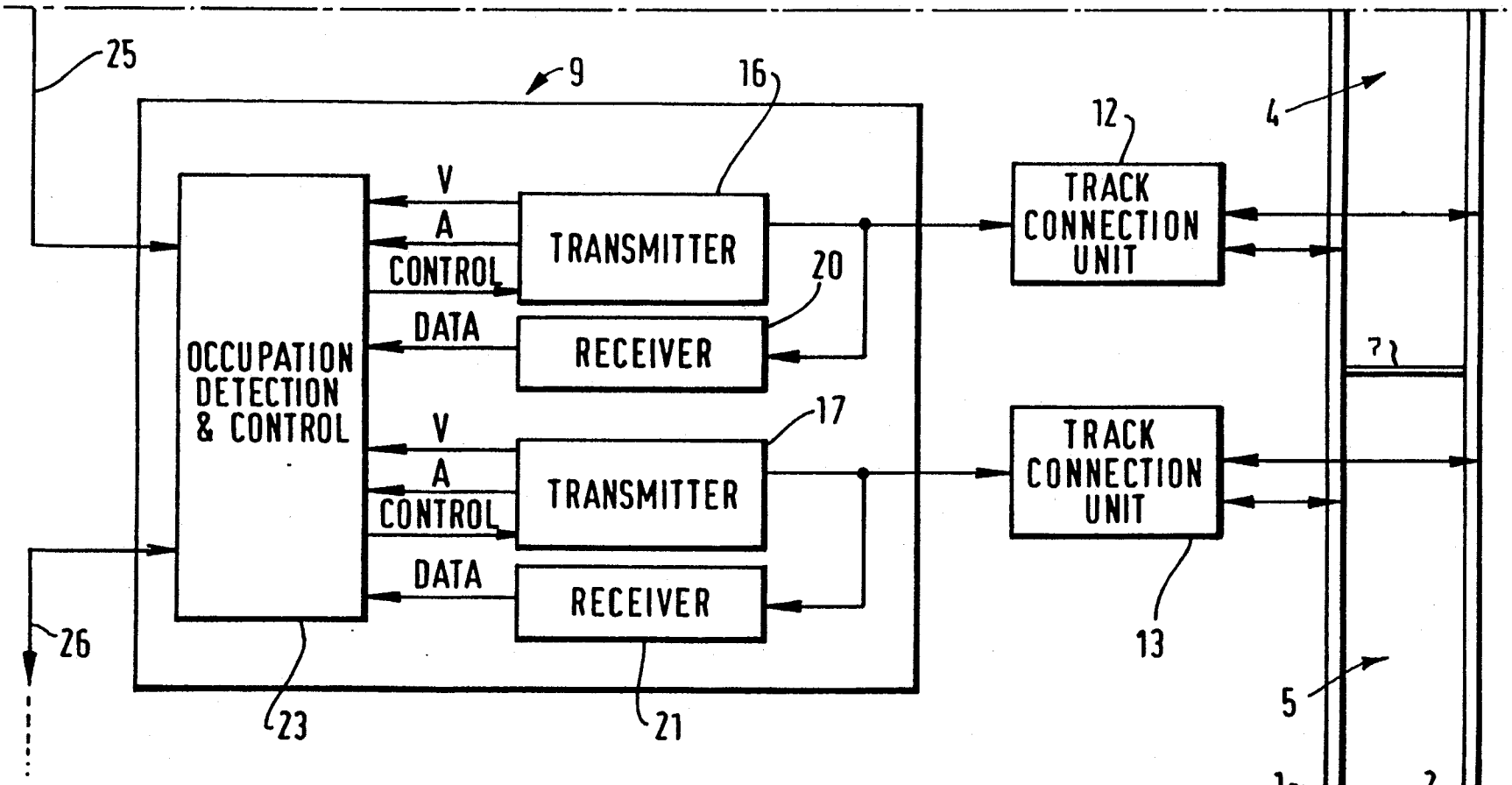

FIGS. 2*a* and 2*b* show two rails 1, 2 divided into three track circuit sections 3, 4, 5 by shorting straps 6, 7. Connected between the rails near each end of each track circuit section is a track connection unit 10, 11, 13, which can both transmit and receive signals in its track circuit section. Each track connection unit is connected to a track circuit unit 8, 9 which transmits and receives signals to and from the track connection unit. Where two track circuit sections meet and there are two adjacent track connection units these are connected to a single track circuit unit.

Each track connection unit is connected to a transmitting unit 14, 15, 16, 17 and a receiving unit 18, 19, 20, 21 in a track circuit unit. The transmitting units send signals to their respective track connection units and the receiving units receive signals from their respective track circuit sections via their respective track connection units. Each track circuit unit also includes an occupation, detection and control unit 22, 23. This transmits signals to control the transmitting units of that track circuit unit and receives voltage and current signals from those transmitting units and data signals from the receiving units of that track circuit unit. The voltage and current signals give information concerning the voltages and currents used by the transmitting units and the data signals give information concerning the signals received by the receiving units.

While the system is operating, each track circuit unit causes its transmitting units to transmit signals via their respective track connection units into the rails of their respective track circuit sections and can also receive signals, via its track connection units and their respective receiver units, from the other track connection units in those track circuit sections. For example, referring to FIG. 2, track circuit unit 8 causes transmitting units 14 and 15 to transmit signals via track connection-units 10 and 11 respectively into the rails of track circuit sections 3 and 4 respectively. At the same time it can receive signals via track connection unit 11 from track connection unit 12 (which is in the same track circuit section as track connection unit 11) and via track connection unit 10 from another track connection unit (not shown) in track circuit section 3- Each transmitting unit in a track circuit section transmits signals into that track section having a different carrier frequency to the other transmitting unit in that section. The signals transmitted by each transmitting unit are of a characteristic type which allows them to be identified as having been transmitted by that unit.

Two methods of measurement are used by the system to detect the presence and position of vehicles. First, by measuring and analyzing the voltage and current used by a transmitting unit for a particular track circuit section, the occupation, detection and control unit of a track circuit unit can determine the impedance of that track circuit section. This can be used to determine the position of a vehicle in that track circuit section because, in general, the impedance of the track circuit section, as measured by the track circuit unit, is less when a vehicle is present than when no vehicle is present and is lower the closer the vehicle is to the point at which the track connection unit via which the measurement if being made is connected to the track. Second, when a vehicle is present in a track circuit section and its axles connect the two rails of track this greatly reduces the level of signals passing between the track connection units in that section. This effect can provide a test for the presence of a vehicle in a track circuit section.

For the first method of measurement to be used the impedance of the track circuit section when no vehicle is present must be known; and for the second method of measurement to be used each transmitter must transmit a signal sufficiently-strong to be received by its corresponding receiver when no vehicle is present. Therefore, when the system is started the system performs tests to ensure that it will subsequently operate correctly.

Each track control unit is given information relating to the lengths of the connections between its track connection units and their respective track circuit sections and to the lengths of these track circuit sections. From this information the impedance encountered by its transmitters for those track circuit sections may be estimated. Then each track circuit unit causes its transmitting units to transmit signals and from its measurements of the voltages and currents used by the transmitting units the impedance of the track circuit sections to which those units are connected is estimated more precisely. To further increase the accuracy of this method the measurements of voltage and current are taken at a series of different frequencies and the results of those measurements are compared.

To ensure that the signals transmitted by each track circuit unit in a track circuit section are strong enough to be detectable by the other track circuit unit in that track circuit section each track circuit unit causes its transmitting units to transmit information identifying themselves and indicating the level of signal being received by them from the transmitting units of the other track circuit units in their respective track circuit sections. This information is received by the other track circuit units who use the information to determine whether to alter the strength of the signal transmitted by their transmitting units. This process continues until the strengths of the signals transmitted by each transmitting unit are satisfactory.

Figure 1:
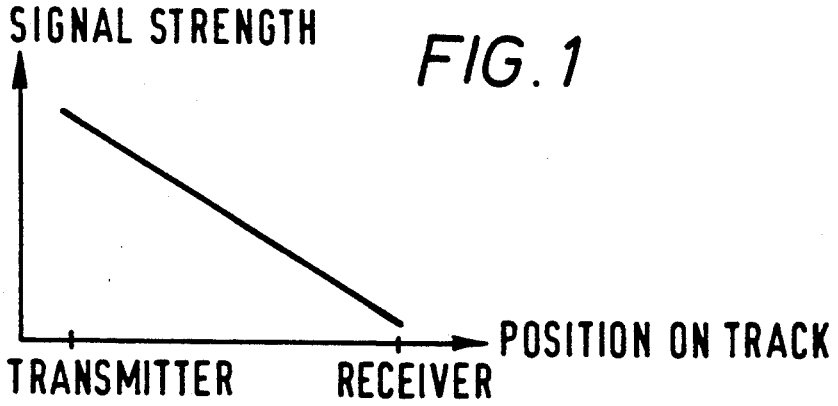
Figure 3:
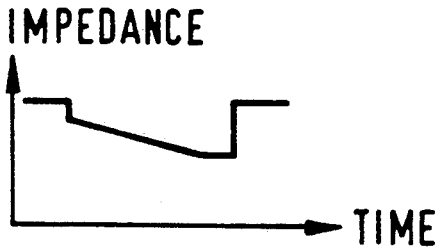
FIG. 3 shows an example of the variation of the measured impedance of a track circuit section with time as a vehicle moves through the track circuit section in a direction away from a unit measuring the impedance.
Figure 4:
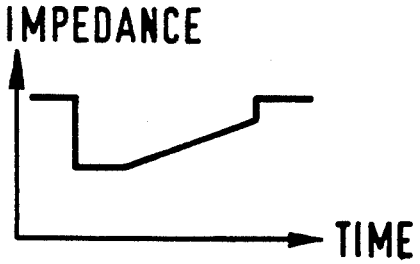
FIG. 4 shows an example of the variation of the measured impedance of a track circuit section with time as a vehicle moves through the track circuit section in a direction towards a unit measuring the impedance.

When the system is operating normally, each track circuit unit monitors the impedance encountered by its transmitting units. For example, referring to FIG. 2, the occupation, detection and control unit 22 of track circuit unit 8 monitors the impedance of track circuit section 3 using the voltage and current signals it receives from transmitting unit 14 and monitors the impedance of track circuit section 4 using the voltage and current signals it receives from transmitting unit 15. When a vehicle enters track section 4 the measured impedance of that section falls and the subsequent changes in the measured impedance of the section depend on the subsequent movement of the vehicle. If the vehicle has entered the track circuit section from the end farthest from the point at which track connection unit 11 is connected to that track circuit section then as the vehicle approaches that track connection unit and then passes into track circuit section 3 the impedance of the track circuit section as measured by occupation, detection and control unit 22 will vary generally as shown in FIG. 3: the impedance decreases as the vehicle approaches track connection unit 11, remains constant until the last axle of the vehicle passes the point at which track connection unit 11 is connected to the track and the vehicle enters track circuit section 3, and the impedance then rises to its original level. If the vehicle has entered the track circuit section from the end nearest to the track circuit unit 11 than as it recedes from that unit and passes into track circuit section 5 the measured impedance of the track circuit section will vary as shown in FIG. 4: the impedance remains constant until the last axle of the vehicle has passed the point at which track connection unit 11 is connected to the track and then rises until the vehicle leaves track circuit section 4 when the impedance returns to its original level. Therefore, it is possible for the system to deduce the direction of movement of vehicles within track circuit sections.

When, by monitoring the impedance of a track section, a track circuit unit detects that a vehicle has passed from one of the track circuit sections in which its track connection units are connected into the other such section it conducts a test to confirm the vehicle's presence in the latter track section and to ensure that no fault has occurred, for example because of earth leakage. The track circuit unit tests for any signal received via its track connection unit in the section into which the vehicle is thought to have passed. If no vehicle is present, a signal should be received from the other track connection unit in that section. If a vehicle is present, little or no such signal should be received. Therefore, where such a signal was previously received, if no such signal is now received or the received signal is now below a threshold level then that is taken to be confirmation that the vehicle has indeed entered the section. Otherwise, if the signal is now above the threshold level or is not of the type transmitted by the other track connection unit in that section or if no signal was previously detected then a possible fault in the system has been detected. For example, referring to FIG. 2*a*, if track circuit unit 8 detects, by monitoring the impedance of track circuit section 3, that a vehicle has passed from track circuit section 3 to section 4 then it tests the signal it receives from track connection unit 11 to find whether that unit is receiving a signal from track connection unit 12. If such a signal is not received, where previously one was received, then that confirms the passage of the vehicle into track circuit section 4.

Each track circuit unit may be connected to an overall control system to which it transmits data concerning the presence and position of vehicles it detects. Since two track circuit units have track connection units in any particular track circuit section the data from these units may be compared by the overall control unit to confirm the position of a vehicle in that section or to test for faults in the track circuit system. Alternatively, adjacent track control units may be connected together by connections 24, 25, 26 to allow them to compare data concerning the presence and position of any vehicles in the track circuit section in which they both have track connection units. That data may then be transmitted to an overall control system.

The two track connection units in a track circuit section may each transmit signals continuously or intermittently into that track section. If signals are transmitted intermittently by a track connection unit then they may be transmitted in a pattern which is characteristic of that unit or of the track circuit section into which it is transmitting. This allows a train equipped with a receiver to determine which track circuit section it is in by receiving and interpreting the pattern.

Figure 5:
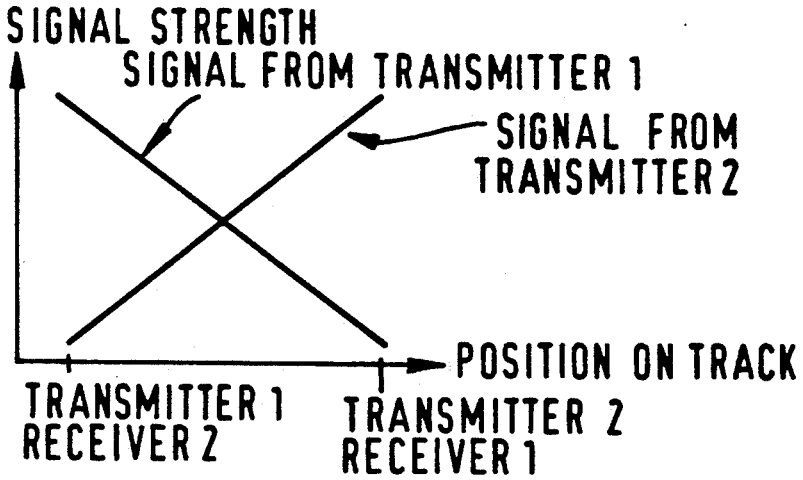
FIG. 5 illustrates the variation of the strength of transmitted signals through a track circuit section.

The provision of a transmitter at each end of the track circuit section overcomes the problem which arises when, due to attenuation, only a relatively weak signal is present in some regions of the track circuit section. Instead, the levels of the signals in a track circuit section are generally as shown in FIG. 5: each signal becomes weaker as it travels further from its transmitter but there is no region of the circuit where only a very weak signal is present.

In FIG. 2, the track connection units are indicated as being connected directly to the rails but, instead, they could be coupled inductively with the rails without the need for a direct connection.

I claim:

1. A railway track circuit system comprising:

a) a railway track having electrically conductive rails including first and second track circuit sections adjacent one another;

b) a first transmitter of signals coupled with the rails in said first track circuit section near a first end of that section;

c) a second transmitter of signals coupled with the rails in said first track circuit section near a second end of that section, opposite said first end;

d) a first receiver of signals coupled with the rails in said first track circuit section near said first end of that section, for receiving signals from said second transmitter;

e) a second receiver of signals coupled with rails in said first track circuit section near said second end of that section, for receiving signals from said first transmitter;

f) a third transmitter of signals coupled with the rails in said second track circuit section near a first end of that section, adjacent said first end of said first track circuit section;

g) a fourth transmitter of signals coupled with the rails in said second track circuit section near a second end of that section, opposite said first end of that section;

h) a third receiver of signals coupled with the rails in said second track circuit section near said first end of that section, for receiving signals form said fourth transmitter; and i) a fourth receiver of signals coupled with the rails in said second track circuit section near said second end of that section, for receiving signals form said third transmitter, in which system:

j) the first transmitter, the third transmitter, the first receiver and the third receiver are coupled in a discrete track circuit unit to occupation detection circuitry in that unit, said occupation detection circuitry being adapted to:

1) estimate the impedance of the first track circuit section for producing an indication of the position of a vehicle in that section; and
2) determine whether a signal from the fourth transmitter is received by the third receiver at a strength greater than a predetermined strength, in response to the estimate of the impedance of the first track circuit section being indicative of a vehicle having passed out of the first track circuit section towards the second track circuit section.

2. A railway track circuit system according to claim 1, in which the system includes a control unit for receiving data from the track circuit unit concerning the presence and position of vehicles int he first and second track circuit sections.

3. A railway track circuit system according to claim 1, in which each of the transmitters is capable of transmitting signals intermittently in a predetermined pattern.

4. A railway track circuit system according to claim 3, in which the pattern is respective to the track circuit section in which the transmitter is coupled.

5. A railway track circuit system according to claim 3, in which the pattern is characteristic of the transmitter.

* * * * *